United States Patent [19]

Moslener

[11] 3,945,585

[45] Mar. 23, 1976

[54] APPARATUS FOR ON-LINE COILING OF WIRE-LIKE MATERIALS, AND RELATED METHOD

[75] Inventor: Jorn Moslener, Angermund, Germany

[73] Assignee: Demag Aktiengesellschaft, Germany

[22] Filed: Nov. 27, 1974

[21] Appl. No.: 527,744

[30] Foreign Application Priority Data

Nov. 28, 1973 Germany ..... 2359139

[52] U.S. Cl. ..... 242/81

[51] Int. Cl.[2] ..... B21C 47/00

[58] Field of Search ..... 242/81, 82, 78.1, 79

[56] References Cited

UNITED STATES PATENTS

| | | | |
|---|---|---|---|
| 1,660,608 | 2/1928 | Flynn | 242/81 |
| 1,793,104 | 2/1931 | Larsen | 242/81 |
| 1,977,668 | 10/1934 | Dallas | 242/81 X |
| 2,306,466 | 12/1942 | Patterson | 242/81 X |
| 3,300,157 | 1/1967 | Koreishi | 242/78.1 |

*Primary Examiner*—Edward J. McCarthy
*Attorney, Agent, or Firm*—Mandeville and Schweitzer

[57] ABSTRACT

The disclosure relates to a coiling stand arranged to receive hot wire-like material, directly from a rolling mill or other forming mill and to wind the material into convenient coils. The coiling stand is positioned to receive wire-like material tangentially, and includes a novel and highly effective sleeve-like guide bell, which surrounds a portion of the spool. As a fresh end of hot wire-like material leaves the coil stand at high speed and approaches the coiling stand, it is directed into the space between the spool and the surrounding guide bell. The leading end of the material is thus captured and guided to the desired position, as the winding operation is initiated. As soon as a few convolutions of the coil are wound, the guide bell may be retracted axially. Desirably, however, it is not fully retracted, but continues to isolate the initial one or two convolutions, for easy subsequent access. The new coiling stand also includes provisions for advancing the guide bell axially over the spool, at the conclusion of a winding operation, to strip the just-wound coil from the spool. The new system is simplified, yet extremely efficient and reliable.

10 Claims, 1 Drawing Figure

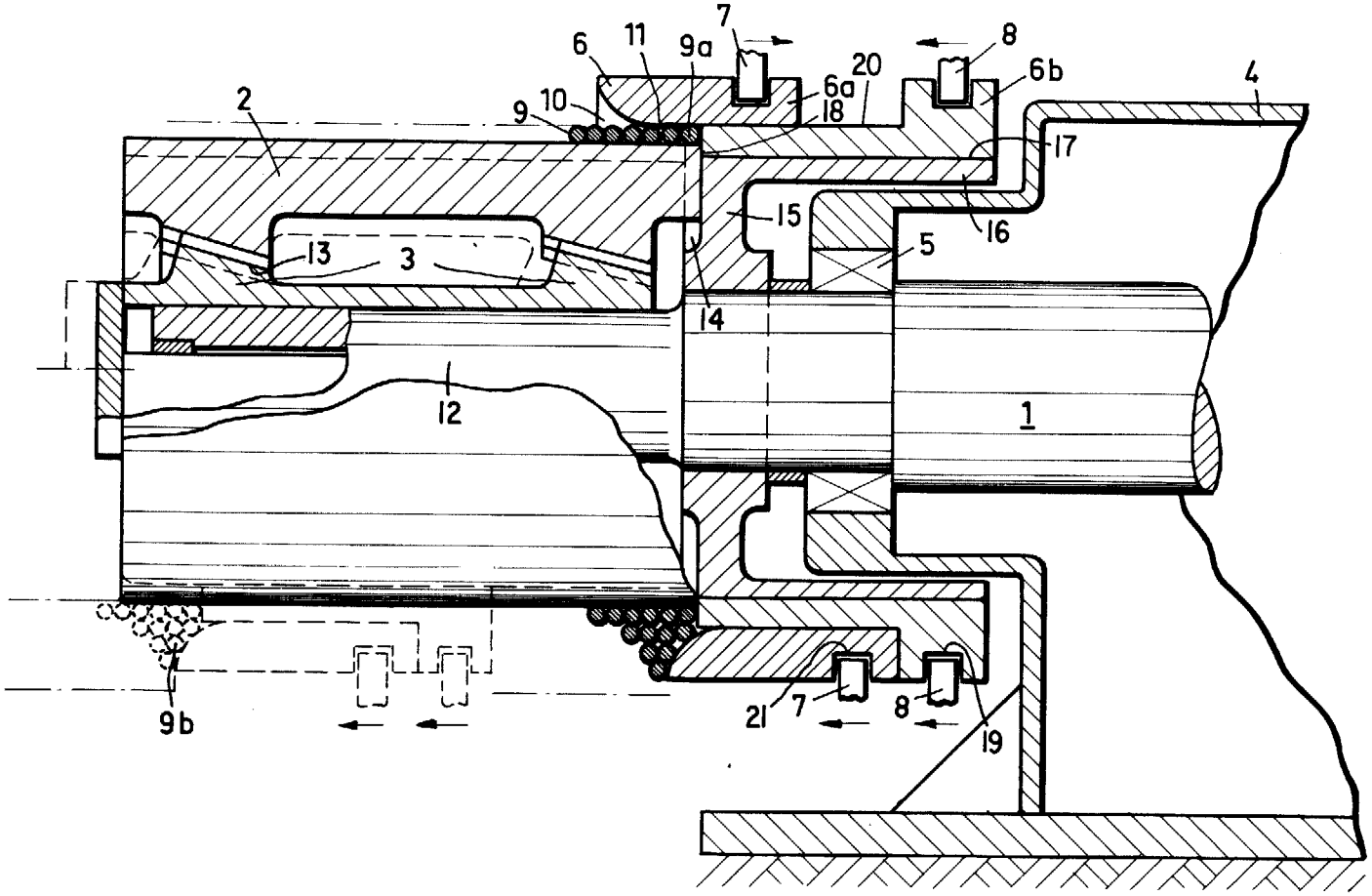
4
6b
8
17
16
20
6a
18
7
9a
11
6
10
9
2
13
3
15
5
14
1
12
19
8
7
21
9b

APPARATUS FOR ON-LINE COILING OF WIRE-LIKE MATERIALS, AND RELATED METHOD

BACKGROUND AND PRIOR ART

In the operation of modern, high speed rolling mills, for the production of wire and similar rolled steel products, it is important to provide for the on-line winding of the wire-like material, as it is discharged at high speed and in a hot condition from the forming mill. In this connection, the efficient performance of the rolling mill is dependent, to a large extent, on the performance of the coiling equipment at the discharge end. Any malfunction or other discontinuity in the operation of the coiling device will entail an interruption in the operation of the entire rolling mill. It is therefore important to utilize coiling devices of a highly reliable and efficient nature, and which are capable of a relatively high coiling capacity.

One known mechanism for the purpose is the so-called Edenborn winder, in which the wire-like material is first guided through a revolving pipe and is directed by the pipe into a receiving basket. The Edenborn equipment, however, has certain significant limitations with respect to speed. Thus, with increasing speeds of discharge from the rolling mill, the friction of the material in passing through the pipe may exceed the stability of the still-hot material discharged from the mill. When this occurs, the wire-like material folds up at the entry end of the pipe, requiring the shut down of the entire line while the ensuing mess is cleared.

Another known prior art device is the so-called Garret winder, in which the wire-like material is directed more or less tangentially into a basket-like container, which is being rotated at a speed appropriate to the discharge of the material from the forming mill. The basket-like container usually consists of a bottom plate and a plurality of distributed vertical rods forming the circumference of the container. A combination of gravity and centrifugal force is utilized to form the coil in the container in coiling operations. One significant shortcoming of the Garret-type winder concerns the fact that, with high speed forming mills, the basket-like container must be rotated at high speed, and the centrifugal forces involved cause the vertical rods, forming the circumference of the basket, to bend outward. Consequently, this type of equipment can only be used effectively at relatively lower speed. The utilization of a solid container, while it would avoid the problem caused by centrifugal deflection, introduces difficulties in connection with the coiling operation, and also involves excessive momentum in the rotating container, resulting in unfavorable economical considerations.

Both of the above described, previously known types of equipment have a characteristic disadvantage of providing poor coil density and uniformity, occasioned by the fact that the wire is directed into the receiving container in a more or less random manner. This can result in significant difficulties when unwinding the wire for further processing, as the convolutions of disorderly coils often become entangled.

While it is known to be desirable to wind coils in uniform layers on the exterior of a spool, and winding stands of this nature are well known, there has been no practical such device having an efficient capability of picking up the fresh end of a wire-like material arriving at high speed from a high speed rolling mill. One known device of the last described type includes a winding spool arranged to receive material moving in an axial direction. The means for engaging the fresh end of rapidly moving material includes a clamping device, surrounding one end of the spool, and a guide for engaging the fresh end of material and leading it toward and into the clamping device. This is disclosed in German publication No. 2,027,516. A serious limitation of such equipment, however, is that, when the hot, rapidly moving material is first introduced into the guide means, the axially moving wire-like material engages an axially stationary guide wall. The friction occasioned by this relative movement frequently causes the still hot and relatively unstable wire-like material to fold up, requiring the processing line to be shut down.

SUMMARY OF THE INVENTION

In accordance with the present invention, a new coiling apparatus and procedure is provided which eliminates the important disadvantages of the known prior art devices, enabling wire-like material to be efficiently wound in an on-line basis as it comes directly from a high speed forming mill. The equipment of the invention is simple, rugged, yet highly efficient, enabling the forming of highly uniform, dense coils of relatively large size, such that the rolling mills may be kept in operation with an optimum efficiency.

Pursuant to the invention, a winding spool is arranged generally at right angles to the line of advance of the wire-like material, as it is discharged from the rolling mill or other forming mill. The spool is arranged to be operated at a speed just slightly greater than the normal speed of advance of the material, in order to maintain a slight tension during the wind-up. As a significant feature of the invention, a novel guide bell arrangement is provided at one axial end of the spool. The guide bell is rotatable with the spool, but is axially displaceable along the spool in the performance of its function. Thus, in a "start" position, the guide bell surrounds one end portion of the spool, providing an annular recess of a thickness somewhat greater than one layer of the material. The outer end of the guide bell is flared upwardly, to facilitate the insertion into the annular space of a fresh end of the wire-like material at the start of a wind-up operation. The guide bell thereafter is retractable, to accommodate winding of large, heavy coil.

In accordance with another and more specific aspect of the invention, the guide bell is of a two part construction, consisting of an inner sleeve-like member and an outer sleeve-like member. The outer sleeve-like member forms the principal guide means to receive the incoming fresh end of material, while the inner sleeve-like member serves to confine axially the end of the material, in order to locate the initial convolution. The two parts of the guide bell are axially displaceable, independent of each other, enabling the outer sleeve to be axially retracted, without moving the inner member, immediately after the start up of a winding operation. At the end of a winding operation, both parts of the guide bell may be axially moved together, for stripping off the wound coil from the wind-up spool.

For a better understanding of the above and other features and advantages of the invention, reference should be made to the following detailed description of a preferred embodiment of the invention, and to the accompanying drawing.

DESCRIPTION OF THE DRAWING

The single FIGURE of the drawing is a longitudinal, cross sectional view of a coil winding stand incorporating the principles of the invention, the portion of the drawing above the longitudinal center line illustrating the equipment as at the start of a coil winding operation, and the portion of the drawing below the center line illustrating the equipment as during and at the end of a coil winding operation.

DESCRIPTION OF A PREFERRED EMBODIMENT

Referring now to the drawing, the numeral 1 represents a spindle shaft, which is supported by suitable bearings 5 in a housing 4. One end of the spindle shaft projects outwardly from the housing 4 and mounts a plurality of spool drum segments 2 which, in the aggregate, form a winding spool. The spool segments 2 are mounted for limited radial movement, by means of an actuator slide 3. The full lines show the spool segments in their normal, expanded positions. The dotted lines, located a short distance radially inward, reflect the radially retracted positions of the spool segments. Appropriate means of a well known type (not shown) may be provided for controlling the position of the slide 3, as will be appreciated. In the illustrated arrangement, the actuator slide 3 is mounted on the outer end extremity 12 of the spindle shaft for limited sliding movement, while the spool segments 2 are slideably engaged with inclined surfaces 13 of the slide. Radial guide ways 14, at the inner end of the spool segments 2, cooperate with similar guides in a fixed collar 15, carried by the spindle shaft, to assist in guiding and supporting the spool segments 2.

The collar 15 is fixed to the shaft 1 and has a rearwardly extending flange 16 forming a cylindrical outer surface 17. In the illustrated arrangement, the surface 17 of the flange has a diameter between the expanded and retracted diameters of the spool segments 2.

Slideably supported on the cylindrical flange 16 is a sleeve-like member **6*b*, forming part of a two-part guide bell assembly 6. At its forward end, the sleeve member 6*b* has an abutment surface 18 arranged, in a normal or retracted position of the sleeve 6*b*, to lie close to the end surface of the spool segments 2. At its inner or rear end, the sleeve member 6*b*, is provided with an annular groove 19 receiving an operating member 8. In conjunction with suitable means (not shown), the operating member 8 serves to slide the sleeve-like member 6*b* axially with respect to the spindle shaft. An outer sleeve-like member 6*a* of the guide bell assembly is slideably supported on surface 20 of the inner sleeve 6*b*. The rearward end of the sleeve is annularly recessed at 21, to receive an operating member 7, by means of which the outer sleeve 6*a* may be advanced or retracted axially on the inner sleeve 6*b***, between the advance position shown in the upper portion of the drawing and the retracted position shown in the lower portion of the drawing.

At its outer extremity, the.sleeve **6*a* is provided with an outwardly flaring guide surface 10, which merges into a cylindrical inner confining surface 11. As reflected in the drawing, the diameter of the cylindrical confining surface 11 exceeds the retracted diameter (dotted lines) of the winding spool by an amount which somewhat exceeds the diameter of the wire-like element 9 to be wound on the spindle. The length of the outer sleeve member 6*a* is such that, in a retracted position, its forward extremity projects slightly beyond the abutment 18** of the inner sleeve, as reflected in the lower portion of the drawing.

In the operation of the coiling stand shown in the drawing, the spindle 1 is initially set into rotation, having a rotational speed such that the winding speed tends to exceed slightly the oncoming speed of the wire-like material, as it is discharged from the last stand of the rolling mill. The spool segments 2, initially, are in a retracted position, at the diameter reflected in the dotted lines in the drawing. Likewise, the outer sleeve **6*a* of the guide bell assembly is actuated to its advanced or projected position, as reflected in the upper part of the drawing. This forms an annular recess at the inner end of the spool assembly 2, defined in part by the radially retracted spool segments, the confining surface 11, and the abutment surface 18. The width of the recess is somewhat in excess of the diameter of the wire-like material 9,** as shown.

The positioned relationship of the rolling mill and winding stand is such that the incoming fresh end of material advances towards the spindle generally tangentially with respect to the outer surface and with an axial component directed towards the recessed end of the spool. As the end reaches the guide bell assembly 6, it is directed by the flaring surface 10 into the recess and eventually into contact with the abutment surface 18. As the leading end **9*a* of the wire is captured in the recess, it will commence to rotate around the spool, being confined by the cylindrical surface 11 of the sleeve member 6*a*** and being held thereagainst by centrifugal force.

After the first few turns of the coil, the actuator 7 is operated to drive the sleeve **6*a* to its retracted position, and simultaneously the slide 3 is shifted to expand the spool segments 2** to the enlarged diameter indicated in full lines in the drawing. Thereafter, the winding operation proceeds, with successive convolutions of the wire-like material being laid side-by-side in the first course, and similarly in successive courses until the desired size of coil is achieved. The suitable level wind guide means (not shown but of conventional construction) may be provided to guide the wire-like material during the main portion of the coil winding operation.

As reflected in the lower portion of the drawing, at least the forward extremity of the outer sleeve **6*a* projects slightly beyond the abutment surface 18,** even in a retracted position of the outer sleeve. This tends to isolate and protect the first one or two convolutions of the coil, during the subsequent portions of the winding operation, so that these convolutions are in a known position and easily accessible in the wound coil.

When a coil **9*b* has been completed, it may be stripped from the spindle by moving the slide 3 outwardly, to retract the spool segments 2, and thereafter advancing axially the guide bell assembly 6*a* 6*b***, pushing the wound coil ahead of it off of the spindle in the manner desired.

The apparatus and procedure of the invention enables dense, compact coils to be wound in an orderly fashion and in a highly reliable manner. The advantage of this are twofold, in that, on the one hand, the rolling operation may be carried on with greater continuity and therefore greater efficiency, because of the significant reliability of the coil winding process, and, on the other hand, a more orderly coil is achieved, in that the successive convolutions may be laid out without entanglement. Also, the initial convolution is in a known position, easily accessible for subsequent paying out of the coil and/or butt welding of the successive coils, for example.

One of the advantageous features of the invention resides in the use of a retractable guide bell arrangement, which initially partly surrounds the winding spool at one end. An incoming end of rapidly moving wire-like element is directed tangentially and with a slight axial component into an annular recess formed in part by the guide bell. The bell guides the fresh end into the proper starting position and confines it temporarily, for the first few convolutions of the winding operation. Thereafter, it is retracted, and winding of the coil continues under slight tension by appropriate driving of the spool. Conveniently, the guide bell assembly is utilized at the conclusion of the coil winding operation to strip the coil axially from the winding spindle.

It should be understood, of course, that the illustrated form of the invention is intended to be representative only, as many changes may be made therein without departing from the clear teachings of the disclosure. Accordingly, reference should be made to the following appended claims in determining the full scope of the invention.

I claim:

1. Apparatus for on-line coiling of wire-like material as it is discharged from a forming mill, which comprises a. a rotatable spool positioned to receive the discharged wire-like material in generally tangential manner with a slight axial component, b. a guide bell positioned at one end of the spool and mounted for rotation therewith, c. said guide bell surrounding said spool in concentric relation, d. a first surface portion of said guide bell having a radially outward flaring end portion facing toward the opposite end of the spool and serving as a guide for a fresh end of wire-like material coming from the forming mill, and e. a second surface portion of said guide bell surrounding said one end of the spool and being spaced radially outward thereof a distance to receive a limited number of convolutions of said wire-like material.

2. An apparatus according to claim 1, further characterized by a. said guide bell being mounted for axial movement along said spool from said one end toward said opposite end, for stripping a completed coil of wire-like material from said spool, and b. means being provided for controllably moving said guide bell axially along said spool.

3. An apparatus according to claim 2, further characterized by a. said guide bell comprising inner and outer sleeve-like members, b. said inner sleeve-like member being slideable on said spool and said outer sleeve-like member being slideable on said inner sleeve-like member, and c. said apparatus further including independent actuating means for said inner and outer sleeve-like members.

4. Apparatus for on-line coiling of wire-like material as it is discharged from a forming mill, which comprises a. a rotatable spool positioned to receive the discharged wire-like material in generally tangential manner with a slight axial component, b. a guide bell positioned at one end of the spool and mounted for rotation therewith, c. said guide bell surrounding said spool in concentric relation, d. a first surface portion of said guide bell having a radially outward flaring end portion facing toward the opposite end of the spool and serving as a guide for a fresh end of wire-like material coming from the forming mill, and e. a second surface portion of said guide bell surrounding said one end of the spool and being spaced radially outward thereof a distance to receive a limited number of convolutions of said wire-like material, f. said guide bell having a first portion slideable axially from a "start" position, surrounding a portion of said spool corresponding to a plurality of coils of the wire-like material arranged side-by-side, to a retracted "winding" position, surrounding a more limited portion of the spool.

5. An apparatus according to claim 4, further characterized by a. said guide bell having a second portion disposed within said first portion and serving as an end wall to axially position the fresh end of the wire-like material, and b. independent means for moving first and second portions axially of said spool.

6. Apparatus for on-line coiling of wire-like material as it is discharged from a forming mill, which comprises a. a rotatable spool comprising a plurality of radially expandable segments, and positioned to receive the discharged wire-like material in generally tangential manner with a slight axial component, b. a guide bell positioned at one end of the spool and mounted for rotation therewith, c. said guide bell surrounding said spool in concentric relation, d. said segments being temporarily retractable at the start of a coil winding operation to facilitate entry of a fresh end of wire-like material into the annular space between said guide bell and said spool, e. a first surface portion of said guide bell having a radially outward flaring end portion facing toward the opposite end of the spool and serving as a guide for a fresh end of wire-like material coming from the forming mill; and f. a second surface portion of said guide bell surrounding said one end of the spool and being spaced radially outward thereof a distance to receive a limited number of convolutions of said wire-like material.

7. The method of on-line winding on a spool of coils of wire-like material as discharged from a forming mill, which comprises a. initially providing a rotating spool of a diameter slightly less than required for the winding of the coil of wire-like material, and rotating at a speed slightly greater than the speed of discharge of the wire-like material from the forming mill, b. initially positioning an annular, outwardly flaring guide surface in surrounding relation to said spool to form an annular guide space, and rotating said surface with said spool, c. directing a fresh end of the wire-like material generally tangentially of the spool and somewhat axially into the annular guide space to initiate the winding operation, and thereafter d. expanding said spool radially to the required diameter for winding the coil and axially retracting said guide surface.

8. The method of claim 7, further characterized by a. providing an abutment surface in conjunction with said guide surface to axially position said fresh end on said spool, and b. maintaining the position of said abutment surface while axially retracting said guide surface.

9. The method of claim 8, further characterized by a. limiting the retracting movement of said guide surface whereby, after retraction, a portion thereof still surrounds said spool to isolate the initial convolutions of said wire-like material for subsequent access.

10. The method of claim 8, further characterized by a. simultaneously projecting axially said guide surface and said abutment surface, upon completion of a coil winding operation, to strip the coil axially from said spool.

* * * * *